United States Patent [19]

Killackey et al.

[11] Patent Number: 4,897,664

[45] Date of Patent: Jan. 30, 1990

[54] IMAGE PLATE/SHORT BACKFIRE ANTENNA

[75] Inventors: Henry T. Killackey, Covina, Calif.; Julia N. Martin, Marion, Va.

[73] Assignee: General Dynamics Corp., Pomona Division, Pomona, Calif.

[21] Appl. No.: 201,972

[22] Filed: Jun. 3, 1988

[51] Int. Cl.[4] ..... H01Q 19/185

[52] U.S. Cl. ..... 343/789; 343/817; 343/819; 343/836; 343/837

[58] Field of Search ..... 343/725, 833–837, 343/909, 838, 840, 781 R, 781 P, 789, 829, 846, 847, 848, 810, 813, 817, 818, 819, 756

[56] References Cited

U.S. PATENT DOCUMENTS

| | | | |
|---|---|---|---|
| 2,130,389 | 9/1938 | Gothe | 343/835 |
| 2,438,343 | 3/1948 | McClellan | 343/755 |
| 2,516,376 | 7/1950 | Field et al. | 342/410 |
| 2,810,906 | 10/1957 | Lynch | 342/367 |
| 2,888,674 | 5/1959 | Moreno | 342/59 |
| 2,972,743 | 2/1961 | Svensson et al. | 343/838 |
| 3,545,001 | 12/1970 | Giller | 343/776 |
| 3,701,158 | 10/1972 | Johnson | 343/725 |
| 3,742,513 | 6/1973 | Ehrenspeck | 343/837 |
| 3,842,421 | 10/1974 | Rootsey et al. | 343/837 |
| 4,183,027 | 1/1980 | Ehrenspeck | 343/789 |
| 4,186,400 | 1/1980 | Cermignani et al. | 343/708 |
| 4,240,080 | 12/1980 | Woodward | 343/817 |
| 4,313,122 | 1/1982 | Dupressoir et al. | 343/818 |
| 4,555,708 | 11/1985 | Waineo et al. | 343/799 |
| 4,698,638 | 10/1987 | Branigan et al. | 343/725 |

OTHER PUBLICATIONS

Immell et al., "A Highly Thinned Array Using The Image Element Antenna", Third Annual Antenna Applications Symposium, Robert Allerton Park, Ill., Sep. 1979, pp. 1–25.

*Primary Examiner*—Rolf Hille
*Assistant Examiner*—Michael C. Wimer
*Attorney, Agent, or Firm*—Neil F. Martin; Leo R. Carroll

[57] ABSTRACT

The described embodiments of the present invention provide a high-gain antenna while allowing for the inclusion of devices within the antenna array. In one embodiment of the invention an array of receiver/transmitter elements is positioned in a pan-like reflector base. The elements are positioned one-quarter of a wavelength from the surface of the base. The wavelength is the wavelength of the chosen frequency of transmission or reception of the antenna. A partially reflective plate is positioned one-half wavelength from the base and thus one quarter wavelength from the elements. Reflective disks are also positioned one-half wavelength above the base and are positioned directly above the elements. The disks create a resonant cavity around the elements for waves of the chosen frequency arriving from near normal to the plane of the base or being emanated from the elements at a normal or near-normal angle. The partially reflective plate extends this resonant area spatially from the element. Because of the extending effect, wider dispersion between array elements may be utilized, wider dispersion between array elements may be utilized while maintaining good gain and side-lobe characteristics. In another embodiment the wider spatial characteristics allow the use of an irregular array. This array allows space for electro-optical devices in the array itself. Another embodiment includes an optically transparent portion of the base. This transparent portion is treated so the surface of it is conductive and thus electromagnetically reflective. The transparent portion allows for optical transmission to sensors located beneath the transparent portion.

24 Claims, 3 Drawing Sheets

IMAGE PLATE/SHORT BACKFIRE ANTENNA

FIELD OF THE INVENTION

The present invention relates to the field of antennas and more particularly to high directivity antennas.

BACKGROUND OF THE INVENTION

Highly bidirectional antennas allow the system designer to "point" the antenna to receive signals from a certain direction or illuminate a relatively small area. For example, in a radar-guided missile, the receiving antenna for the radar is pointed roughly toward the targeted area or object. Directivity and high efficiency see Johnson and Jasik, *Antenna Engineering Handbook* 17–32 (1984)) provides a much stronger signal to the reception circuitry. This increased signal strength increases the effective range and the accuracy of the radar system. Similarity, limiting the received signal to the target area minimizes the risk of jamming signals causing erroneous results from the radar system.

One method known in the prior art for improving directivity in antenna systems is the use of array antennas. Array antennas include multiple receiving elements, usually arrayed on a flat plane in a regular array. The receiving elements are coupled to receiving circuitry by equal length waveguides. Electromagnetic waves traveling in a direction normal to the plane of the antenna array will constructively interfere because they arrive at the receiving elements in phase. On the other hand, waves traveling off of the normal will arrive at the receiving elements at slightly different times. Thus, the signals will be mixed at the coupler out of phase. The degree to which the signals are out of phase may be determined geometrically using the angle of incidence and the wavelength of the received signal. When the signals are one-half wavelength out of phase, the signals will destructively interfere. For angles of incidence between the normal and destructive interference, the signal level at the coupler diminishes from the normal level to the destructive interference level. At an angle farther off the normal from the destructive interference level, the distance induced delay reaches a full wavelength and the signals once against constructively interfere. Such signal interference creates an off normal area of sensitivity known as a side lobe. Side lobes reduce the directivity of the antenna and are thus undesirable.

One technique known in the art for reducing the effect of side lobes is the image plate concept. The image plate idea was originally set forth by Von Trentini, "Partially Reflecting Sheet Arrays," *IRE Transactions on Antennas and Propagation,* October 1956 pp. 666–71. An example of an image plate structure is disclosed in Ballee et al, U.S. Pat. No. 3,990,078.

In an image plate antenna, a partially reflecting sheet of material is placed parallel to the plane of the radiating element or the element. The plane itself is composed of a reflective material. The spacing between the sheet and the plane is one-half wavelength. A wave entering the antenna normal to the plane will be reflected by the plane and then re-reflected off the partially reflective sheet. The wave travels one full wavelength and thus is in phase with the incoming wave. This creates a damped (because the sheet is partially reflective ) resonant cavity. Because of the phase reversal of a wave upon reflection, the receiving elements must be half way between the sheet and the plate for reflected, direct and re-reflected waves to reach the receiving element in phase. See Immell and Sasser, "A Highly Thinned Array Using the Image Element Antenna," Third Annual Antenna Applications Symposium, Motorola Government Electronics Division, September 1979. Waves which enter the antenna off of the normal travel a distance greater than one wavelength depending upon the angle of incidence. Thus, under such circumstances, less than perfect constructive interference occurs, and leads toward destructive interference as the incident angle approaches an angle 60° off of the normal.

The lateral (parallel to the plane) reflection creates a "second source" effect. Because the reflected signals are combined at the array elements along with other reflected waves and direct waves, the signal received by the element is analogous to the signal combined at the coupling of the waveguides, with analogous effects, i.e., increased directivity. However, the image plate concept relies on two competing properties of the partially reflective sheet. On the one hand, the sheet must pass the wave to allow it to be received by the elements at all. On the other hand, the sheet must reflect as much as possible to achieve the resonance effect. Usually dielectric partially reflective sheets allow 70 to 90 percent of the wave to pass and 10 to 30 percent is reflected. With such a small percentage of reflected energy, the image plate effect is negligible after one full reflection.

Another technique for reducing the effect of side lobes is the short backfire technique. An example of the short backfire technique may be found in Ehrenspeck, U.S. Pat. No. 3,742,513. The short backfire antenna is composed of at least one element on a reflective plane. The element is positioned a quarter wavelength above the plane and a reflective plate is positioned directly a quarter wavelength above the element and thus one half wavelength above the plane. Waves entering the antenna at near the normal will establish resonant waves between the plate and the plane, thus enhancing the reception or transmission of normal waves. Incoming waves off of the normal will constructively or destructively interfere in a manner similar to that described for the image plate antenna.

Both the image plate antenna and the short backfire antenna operate, in part, on a spatial dispersion concept that generates "phantom" elements so the antenna behaves as if it had more elements. However, the spatial dispersion from the source element of these phantom elements is limited. This limitation becomes a problem in systems where electro-optic devices must be integrated with the antenna. Because of the space they occupy, the electro-optic devices cause an aperture blockage of the antenna. Aperture blockage causes gain loss and increases side lobes (see Johnson and Jasik, *Antenna Engineering Handbook,* p. 17–32 (1984)). It is a object of the present invention to provide a system which provides a high-gain antenna with minimized side lobes and whichis compatible with the inclusion of electro-optic devices or some other antenna type such as a four-arm monopulse spiral or millimeter-wave homing antenna system.

SUMMARY OF THE INVENTION

The described embodiments of the present invention provide high-gain antenna while allowing for the inclusion of devices within the antenna array. In one embodiment of the invention, an array of receiver/transmitter elements is positioned in a pan-like reflector base. The elements are positioned one quarter of a wavelength from the surface of the base. The wavelength corresponds to the operating frequency of transmission or reception of the antenna. A partially reflective plate is positioned one-half wavelength from the base and thus one-quarter wavelength from the elements. Reflective disks are also positioned one-half wavelength above the base and are positioned directly above the elements. The disks create a resonant cavity around the elements for waves of the chosen frequency arriving from near normal to the plane of the base or being emanated from the elements at a normal or near normal angle. The partially reflective plate extends this resonant area spatially from the element. Because of the extending effect, wider dispersion between array elements may be utilized while maintaining good gain and side lobe characteristics.

In another embodiment, the wider spatial characteristics allows the use of an irregular array. This array allows space for electro-optic devices in the plane of the array itself. The expanded spatial area of the elements "fills in" the irregularity of the array. The antenna thus provides directionality, gain and side lobe characteristics of a more regular array. Another embodiment includes an optically transparent portion of the base. This transparent portion is treated so the surface of it is conductive and thus electromagnetically reflective. This characteristic promotes the spatial effect of the partially reflective plate over the transparent portion. The transparent portion allows for optic transmission to sensors located beneath the transparent portion. The spatial enhancement due to the reflectivity of the transparent allows the array to provide excellent gain, directionality and side lobe characteristics in spite of the aperture blockage which would harm those characteristics in prior antennas.

BRIEF DESCRIPTION OF THE DRAWINGS

The present invention will be better understood from the following detailed description of the preferred embodiments of the invention, taken in conjunction with the accompanying drawings, in which like reference numerals refer to like parts, and in which.

DETAILED DESCRIPTION OF THE PREFERRED EMBODIMENTS

Figure 1:
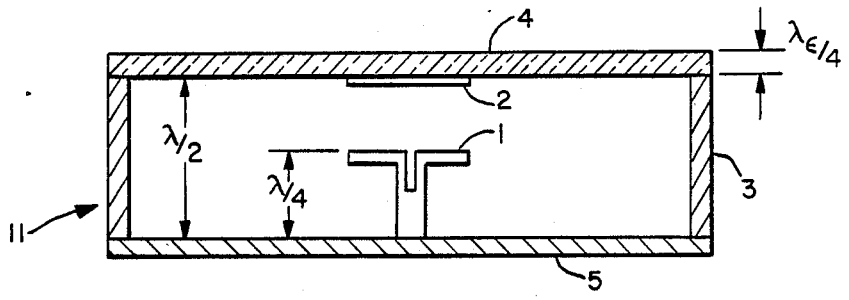
FIG. 1 is a side view schematic diagram showing an embodiment of the invention including a single transmitting/receiving element.

FIG. 1 is a side view schematic diagram depicting an embodiment of the present invention including a single radiating element. Dipole 1 is positioned one-quarter of one wavelength above reflective base 5. Mechanically attached to reflective base 5 is rim 3. Partially reflective plate 5 is formed one-half wavelength above reflective base 5 in a position parallel to reflective base 5. In another embodiment of the invention, rim 3 is omitted and partially reflective plate 4 is supported by other means such as posts (not shown) positioned between partially reflective plate 4 and reflective base 5. Reflective base 5 may be any reflective material but is usually a conductive metal such as copper or aluminum. Partially reflective plate 4 is formed of fused silica but may be formed of any suitable dielectric material. Reflective plate 2 is formed on the surface of partially reflective plate 4 by vapor deposition and masking and etching techniques similar to those used in the integrated circuit technology. In the described embodiment, reflective plate 2 is formed of chromium and is approximately one half wavelength in diameter. As an alternative embodiment, reflective plate 2 may be separately formed and attached to partially reflective plate 4 by a number of suitable adhesives. Partially reflective plate 4 is chosen to be one-quarter wavelength in thickness to maximize the reflective potential of the dielectric material, in the described embodiment, fused silica. Fused silica is chosen for this embodiment, in part, because of its optical transparency. In embodiments where optical transparency is not required, opaque or translucent dielectrics may be used. One quarter wavelengths thickness is derived in Immell and Sasser, supra. The actual thickness of partially reflective plate 4 will be thinner than one-quarter wavelength in the air because the velocity of propagation of radiofrequency (RF) radiated energy through the dielectric medium is altered, thus altering the wavelength within the dielectric medium. That is, the wavelength within the dielectric medium is calculated by the well-known relationship wherein the wavelength within the dielectric medium is inversely proportional by the square root of its relative dielectric constant to its wavelength in air. This is chosen so that partially reflective plate 4 is one-quarter wavelength for the wavelength of a wave traveling through the dielectric medium.

Figure 2:
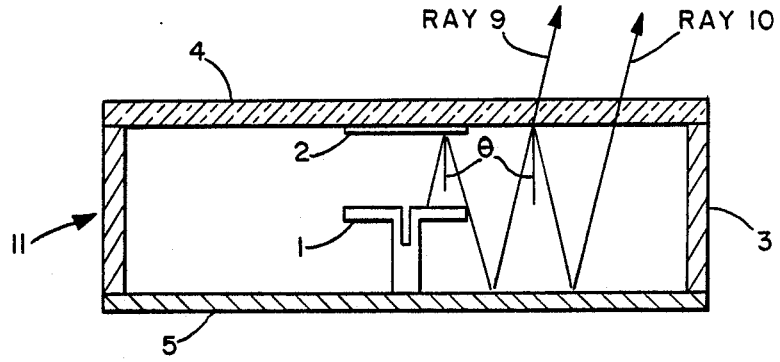
FIG. 2 is a side view schematic diagram showing the path of a radiated wave of the embodiment shown in FIG. 1.

FIG. 2 is a side view schematic diagram of the embodiment shown in FIG. 1. Ray 9 is an electromagnetic wave radiated from dipole 1 so that ray 9 reflects off reflective plate 2 at an angle of incidence of $\theta$. Radiating element 1 may be any of a number of radiating sources known in the art such as slots and monopoles; radiating element 1 is a dipole in this embodiment for exemplary purposes only. Ray 9 is completely reflected off reflective plate 2 at an angle off of the normal equal to the angle of incidence $\theta$. Ray 9 is then reflected off of reflective base 5 at an angle of incidence $\theta$ and is preferably passed through partially reflective plate 4. Ray 9 will also reflect off of partially reflective plate 4 to produce ray 10 which reflects back to base 5 at an angle of incidence $\theta$, reflects off the reflecting base 5 and passes through partially reflective plate 4. Further reflections from partially reflective plate 4 off of ray 10 occur, but are not shown in FIG. 2 for clarity. Using the calculations determined by Immell and Sasser, supra, and the relative dielectric coefficient of 3.78 of fused silica, ray 9 passing through partially reflective plate 4 will have approximately 73.5 percent of the intensity of ray 9 before passing through partially reflective plate 4. The remaining 26.5 percent of the energy is reflected back to form ray 10.

To a distinct receiver, ray 9 and ray 10 appear to be from different elements separated from each other by a distance equal to twice the distance between partially reflective plate 4 and reflective base 5 times the sine of $\theta$. Ray 9 and ray 10 arrive at the distant receiver as if they originated from two radiating sourdces. The point where ray 9 and ray 10 will perfectly constructively interfere is when $\theta$ is equal to zero. However, as can be seen from FIG. 2, a wave radiated from radiating element 1 at an angle of incidence of zero will reflect back and forth between reflective plate 2 and reflective base 5. Those waves striking reflective plate 2 at very small angles of $\theta$ will constructively interfere many times before reaching the edge of reflective plate 2 and radiating forward. These highly directional waves are further reflected by partially reflective plate 4. These reflections tend to have a spreading effect of the constructive combinations as described with ray 9 and ray 10. Thus the effective spatial area of radiating element 1 is expanded by the addition of partially reflective plate 4. Also, the signals radiating from radiating element 1 are caused to be highly directional by the combination of the effects of reflective plate 2 and partially reflective plate 4. Directivity and spatial effects of this antenna also occur antenna 11 is used for receiving. The analysis is simply the reverse of that for radiating waves. This can be seen visually by reversing the direction of rays 9 and 10 to incoming wavs received by element 1.

Figure 3:
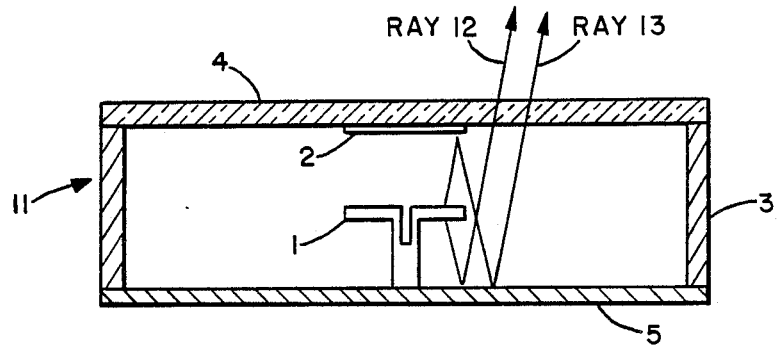
FIG. 3 is another diagram showing two radiated waves from the embodiment shown in FIG. 1.

FIG. 3 is a side view schematic diagram of antenna 11 showing the analysis for electromagnetic waves emerging from radiating element 1 in opposite directions. Ray 12 radiates from element 1 down to reflective base 5 and is reflected forward through partially reflective plate 4. The reflected wave from partially reflective plate 4 is not shown for clarity. Ray 13 radiates upward from radiating element 1, is reflected off of reflective plate 2, and is reflected off reflective base 5 through partially reflective plate 4. The partially reflected waves from ray 13 are not shown for clarity. When electromagnetic waves are reflected, they are inverted in phase. This is equivalent to being shifted by one-half wavelength. Ray 13 is reflected off reflective plate 2 and reflective base 5. Because ray 13 is reflected twice, ray 13 is inverted once and then inverted back again to the original phase as emitted from radiating element 1. However, ray 13 travels up one-quarter wavelength and down one-quarter wavelength more than ray 12. Therefore, ray 13 is shifted one-half wavelength because of the additional distance ray 13 must travel over that of ray 12. Ray 13 travels slightly more than one-quarter wavelength because ray 13 is not emitted from radiating element 1 perpendicular to reflective plate 2. However, the closer to the normal ray 12 and ray 13 are reflected from reflective plate 2 and reflective base 5, the stronger the constructive interference between ray 12 and ray 13. This analysis also holds true for received waves as opposed to transmitted waves.

Figure 4:
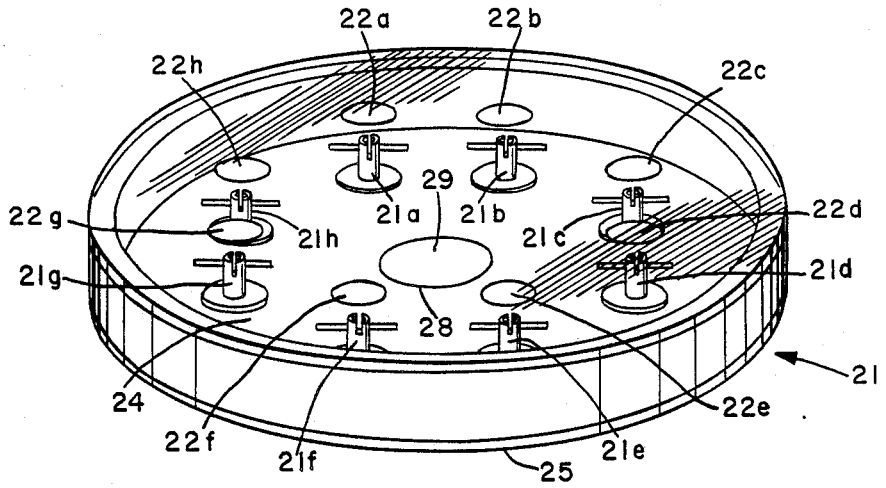
FIG. 4 is a perspective diagram showing an 8 element embodiment of the present invention including an optical portal.

FIG. 4 is a perspective view of another embodiment of the present invention including 8 radiating elements as opposed to the one radiating element of antenna 11. Radiating elements 21*a* through 21*h* are positioned above base 25 one-quarter wavelength as described with regard to antenna 11. Partially reflective plate 24 is positioned one-half of one wavelength above reflecting base 25. Reflective plates 22*a* through 22*h* are formed on the bottom of partially reflective plate 24 using the same techniques as described before for reflective plate 2. Aperture 28 is an opening in the middle of antenna 21 designed to provide an opening for optical sensing devices in the middle of antenna 21. Aperture 28 is covered with a glass plate 29, the surface of which is coated with tin oxide to make the surface of glass plate 29 conductive but still transparent. Because partially reflective plate 24 is fused silica, a form of glass, partially reflective plate 24 is optically transparent. In a typical antenna array system, the inclusion of aperture 28 would cause a discontinuity in the overall aperture amplitude distribution similar to a phenomenon known as aperture blockage. See Johnson and Jasik, supra. However, because of the spatial expansion caused by the interaction of reflecting plates 22*a* through 22*h* and partially reflecting plate 24, the deleterious consequences of aperture blockage are greatly reduced. The conductive surface of glass plate 29 is reflective to the waves radiated/received by elements 21*a* through 21*h*. Thus, the reflective spatial effect described with regard to FIG. 2 occurs over the surface of aperture 28.

Figure 7:
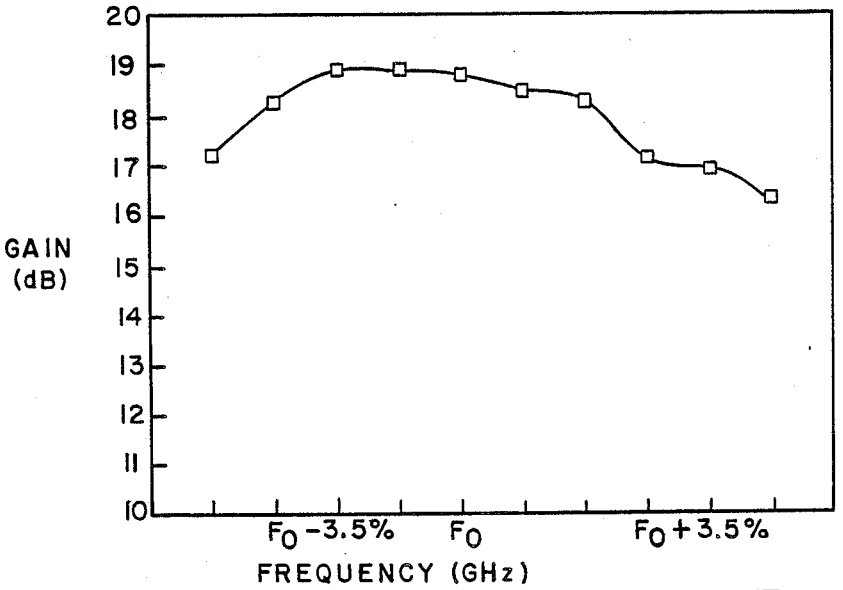
FIG. 7 is a gain-versus-frequency graph over the X band frequency range range of the antenna illustrated in FIG. 4.
Figure 5A:
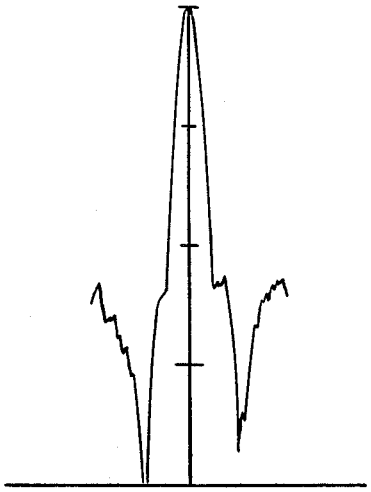
FIGS. 5A and 5B are graphs depicting the directionality of the embodiments shown in FIG. 4.
Figure 6A:
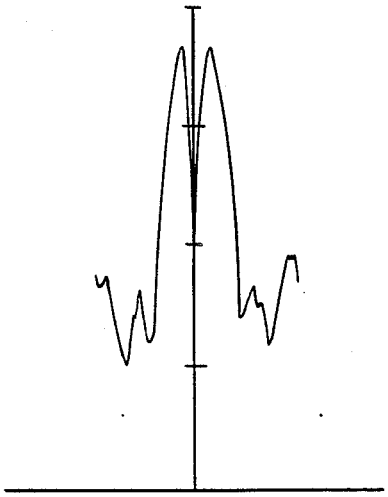
FIGS. 6A and 6B are graphs depicting the radiation characteristics of the embodiment of FIG. 4 using the E and H-plane delta ports.
Figure 5B:
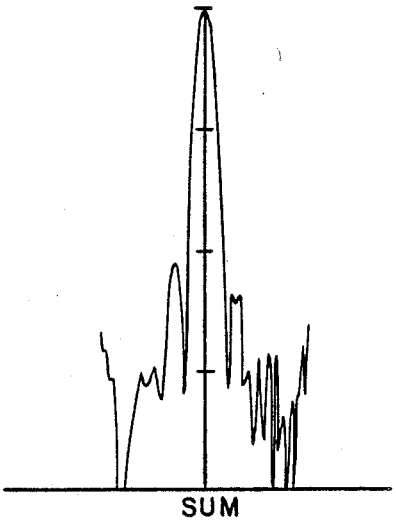
Figure 6B:
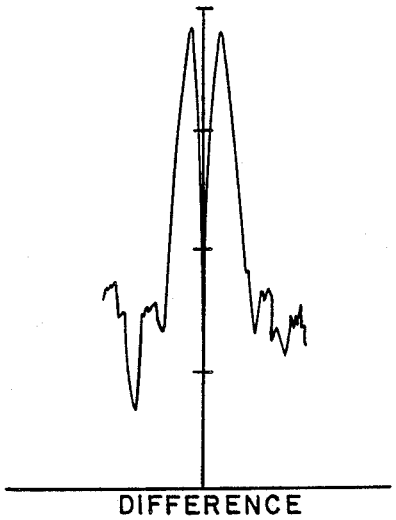

FIGS. 5A and 5B are directivity diagrams at the center frequency (Fo) in the X-band for antenna 21 shown in FIG. 4. The bandwidth of antenna 21 is plus or minus 3.5 percent near 10 GHz. The wavelength dimensions of the antenna of FIG. 4 are designed to operate a frequency Fo. Note that high directivity of the radiation curves even with the inclusion of aperture 28 in antenna 21. FIGS. 5A and 5B are the directivity diagrams for the respective E- and H-plane sum-type waves. FIGS. 6A and 6B are directivity diagrams for the center frequency (Fo) for the respective E- and H-plane difference or delta radiation patterns. FIG. 7 is a graph showing the gain versus frequency of the antenna shown in FIG. 4. The gain realized by this embodiment of the invention is comparable to prior art antennas without aperture blockage.

Although specific embodiments of the present invention are herein described, they are not to be construed as limiting the scope of the invention. For example, rather than an optical device, aperture 28 could be used to house a second type of antenna such as a slot type or a multi-armed spiral type antenna. The scope of the invention is limited only by the claims appended hereto.

We claim:

1. A high-gain antenna for transmitting or receiving electromagnetic radiation comprising:

a reflective base for reflecting electromagnetic radiation;

a radiating element positioned one-quarter of a wavelength above said reflective base;

a partially reflective plate positioned one-half of said wavelength above said reflective base and positioned parallel to said reflective base; and a reflective plate disposed on a surface of said partially reflectiveplate, said reflective plate positioned above said radiating element.

2. The antenna of claim 1 wherein said reflective plate comprises a conductive disk attached to said partially reflective plate.

3. The antenna of claim 1 wherein said reflective base comprises a flat conductive plate.

4. The antenna of claim 3 wherein said reflective base further comprises a rim, said rim formed perpendicular to and around the periphery of said base.

5. The antenna of claim 1 wherein said partially reflective plate has a relative dielectric constant of at least 3.78.

6. The antenna of claim 1 wherein said partially reflective plate has a thickness one-quarter of a wavelength of the electromagnetic radiation traveling through said partially reflective plate, said thickness being inversely proportional to the relative dielectric constant of said partially reflective plate.

7. The antenna of claim 1 where said partially reflective plate is optically transparent.

8. The antenna of claim 1 further comprising an aperture formed in said base, said aperture being filled with an optically transparent material and at least a portion of said optically transparent material being conductive.

9. A high-gain antenna for transmitting or receiving electromagnetic radiation comprising:

a reflective base for reflecting electromagnetic radiation;

a plurality of radiating elements positioned one-quarter of a wavelength above said reflective base;

a partially reflective plate positioned one-half of said wavelength above said reflective base and positioned parallel to said reflective base; and a plurality of reflective plates, each of said reflective plates disposed on a surface positioned one-half of said wavelength above said reflective base and positioned above said plurality of radiating elements.

10. The antenna of claim 9 wherein said reflective plates comprise conductive disks attached to said partially reflective plate.

11. The antenna of claim 9 wherein said reflective base comprises a flat conductive plate.

12. The antenna of claim 11 wherein said reflective base further comprises a rim, said rim formed perpendicular to and around the periphery of said base.

13. The antenna of claim 9 wherein said partially reflective plate has a relative dielectric constant of at least 3.78.

14. The antenna of claim 9 wherein said partially reflective plate has a thickness one-quarter of a wavelength of the electromagnetic radiation traveling through said partially reflective plate, said thickness being inversely proportional to the relative dielectric constant of said partial reflective plate.

15. The antenna of claim 9 where said partially reflective plate is optically transparent.

16. The antenna of claim 9 further comprising an aperture formed in said base, said aperture being filled with an optically transparent material and at least a portion of said optically transparent material being conductive.

17. A high-gain antenna for receiving or transmitting electromagnetic radiation comprising:

a flat conductive base having a rim formed perpendicular to and around the periphery of said base;

a dipole radiating element positioned one-quarter of a wavelength above said base;

a partially reflective plate positioned one-half of said wavelength above said base, said partially reflective plate being positioned parallel to said base; and a reflective plate formed on a surface of said partially reflective plate directly above said radiating element.

18. The antenna of claim 17 wherein said partially reflective plate comprises fused silica.

19. The antenna of claim 17 where said partially reflective plate is optically transparent.

20. The antenna of claim 17 further comprising an aperture formed in said base, said aperture being filled with an optically transparent material at least a portion of said optically transparent material being conductive.

21. A high-gain antenna for receiving or transmitting electromagnetic radiation comprising:

a flat conductive base having a rim formed perpendicular to and around the periphery of said base;

a plurality of dipole radiating elements positioned one-quarter of a wavelength above said base;

a partially reflective plate positioned one-half of said wavelength above said base, said partially reflective plate being positioned parallel to said base; and a plurality of reflective plates formed on a surface of said partially reflective plate directly above said radiating elements.

22. The antenna of claim 21 wherein said partially reflective plate comprises fused silica.

23. The antenna of claim 21 where said partially reflective plate is optically transparent.

24. The antenna of claim 21 further comprising an aperture formed in said base, said aperture being filled with an optically transparent material wherein at least a portion of said optically transparent material being conductive.

* * * * *